United States Patent [19]

de Vrijer

[11] Patent Number: 4,594,529

[45] Date of Patent: Jun. 10, 1986

[54] METAL HALIDE DISCHARGE LAMP

[75] Inventor: Bertus de Vrijer, Eindhoven, Netherlands

[73] Assignee: U.S. Philips Corporation, New York, N.Y.

[21] Appl. No.: 775,110

[22] Filed: Sep. 11, 1985

Related U.S. Application Data

[63] Continuation of Ser. No. 555,920, Nov. 29, 1983, abandoned.

[30] Foreign Application Priority Data

Dec. 1, 1982 [NL] Netherlands ..... 8204653

[51] Int. Cl.[4] ..... H01J 61/12; H01J 61/04; H01J 61/30

[52] U.S. Cl. ..... 313/571; 313/620; 313/634

[58] Field of Search ..... 313/634, 573, 580, 574, 313/620, 639, 570, 571

[56] References Cited

U.S. PATENT DOCUMENTS

| | | | |
|---|---|---|---|
| 2,869,011 | 1/1959 | Verbeck | 313/117 X |
| 3,259,777 | 7/1966 | Fridrich | 313/570 |
| 3,898,504 | 8/1975 | Akutsu et al. | 313/620 |
| 4,029,985 | 6/1977 | Rachel | 313/117 |
| 4,161,672 | 7/1979 | Cap et al. | 313/634 X |

*Primary Examiner*—Palmer C. DeMeo
*Assistant Examiner*—Sandra L. O'Shea
*Attorney, Agent, or Firm*—Robert S. Smith

[57] ABSTRACT

A gas discharge lamp according to the invention has an at least approximately rectilinear and contracted arc and a high efficiency even in a horizontal operating position. Consequently, the lamp is suitable for use, when arranged in a reflector, as a vehicle headlight lamp. The lamp comprises an ionizable filling of rare gas, mercury, and metal iodide, the quantity of mercury being dependent upon the inner diameter D of the lamp envelope (1), the distance d between the tips of the electrodes (2), and the distance l over which the electrodes project into the lamp envelope. The values of D, d, l and the wall thickness t of the lamp envelope lie within indicated limits. The lamp, which may be provided with a screen, may have a lamp cap or may be incorporated into a reflector with a front pane.

13 Claims, 4 Drawing Figures

METAL HALIDE DISCHARGE LAMP

This is a continuation of application Ser. No. 555,920, filed Nov. 29, 1983, now abandoned.

The invention relates to a gas discharge lamp, suitable for use in a reflector as a vehicle headlight lamp, comprising a lamp envelope of quartz glass having an elongate discharge space in which a respective electrode is arranged near each of its ends, current-supply conductors being passed from these electrodes through vacuum-tight seals in the lamp envelope to the exterior, the lamp envelope being filled with an ionizable gas filling. Such a lamp is known from German Patent Specification No. 2,043,179.

The use of a gas discharge lamp in headlights of vehicles is advantageous due to the high efficiency of discharge lamps as compared with the incandescent lamps which are generally used. However, a disadvantage of the known lamp is the extent of the discharge arc because a compact light source is required for obtaining a good light beam. The use in headlights further involves the gas discharge lamp being arranged with the discharge track substantially horizontal. This arrangement results in the discharge arc being curved in an upward direction. However, this exerts a very unfavorable influence on the light beam produced by the headlights. Especially for lamps used with a reflector, a front pane, and a screen screening a part of the reflector to produce a low beam for vehicles, it is of importance that the discharge arc is contracted (not diffuse) and is at least approximately rectilinear.

The invention has for its object to provide a gas discharge lamp which in the horizontal operating position yields a contracted and at least approximately rectilinear discharge arc and a high efficiency.

In accordance with the invention, this is achieved in a gas discharge lamp of the kind mentioned in the opening paragraph in that the gas filling comprises rare gas, mercury, and a metal halide, in that the wall thickness t of the lamp envelope halfway between the electrodes is 1.5–2.5 mm, in that the inner diameter D of the lamp envelope halfway between the electrodes is 1–3 mm, the distance d between the tips of the electrodes is 3.5–6 mm, the distance l over which the electrodes each project into the lamp envelope is 0.5–1.5 mm and in that the quantity A, in mg, of mercury in the lamp envelope corresponds to the formula:

$$0.002(d+4\cdot l)D^2 \leqq A \leqq 0.2(d+4\cdot l)D^{\frac{1}{2}}$$

in which D, d and l are expressed in mm.

It has been found that the discharge arc of this discharge is contracted and at least approximately rectilinear and yields a high efficiency. Halfway between the electrodes, the discharge arc has a diameter of not more than approximately 1.5 mm. The term "diameter" is to be understood herein to mean the distance between two diametrically opposed points of the arc, measured halfway between the electrodes, at which the light intensity is 20% of the maximum intensity of the arc. This small diameter illustrates the contracted no-diffuse character of the arc. Also halfway between the electrodes, the center line of of the discharge arc is displaced less than 0.5 mm with respect to the imaginary line interconnecting the points at which the arc terminates on the electrodes.

These properties of the discharge arc are obtained by all of the measures by which the lamp according to the invention is distinguished from the known lamp described in the opening paragraph. With quantities of mercury larger than the defined quantity, the discharge arc is curved, whereas with smaller quantities the efficiency of the lamp is unacceptably low. Also with higher values of D, the discharge arc is curved and not contracted, whereas with values smaller than the defined value, the efficiency is unacceptably low due to thermal losses. The metal halides are found to have evaporated to an insufficient extent, as a result of which the efficiency of the lamp is too low, if the electrodes project into the lamp over a distance l larger than the defined distance, whereas with a smaller distance the glass of the lamp envelope is thermally loaded to an inadmissably large extent. The wall thickness t is of importance for the temperature of the lamp envelope. With thicknesses smaller than the indicated value, there are large temperature differences along the circumference of the lamp envelope: on the upper side, the lamp envelope externally has a temperature higher that that to which the glass is resistant, whereas on the lower side it has too low a temperature. If the wall of the lamp envelope is thicker than the maximum value, the whole lamp envelope obtains too low a temperature to have a satisfactory efficiency. Both with larger and with smaller values of d, it is not possible to produce a good light beam with the lamp.

As a starting gas, the lamp contains a rare gas, for example, argon, krypton, xenon, or mixtures thereof, at a pressure of 3000 Pa or higher. Examples of metal halides that can be used are the iodides of rare earth metals, scandium, thorium, alkali metal, tin, thallium, indium and cadmium and mixtures of iodides such as scandium iodide, thorium iodide and sodium iodide. They increase the efficiency of the lamp and provide for the mercury discharge a better, less blue color and a better color rendition, which is of importance for the observation and interpretation of traffic signs. At an operating voltage of approximately 80–120 V, the lamp consumes a power of approximately 20–50 W.

As to the form of the discharge space, the lamp according to the invention bears a slight resemblance to lamps known from U.S. Pat. No. 3,259,777. However, the lamps described therein have deviating properties which render them unsuitable for use in vehicle headlights. The lamps consume high to very high powers, as a result of which the luminous flux generated is unacceptably high. Furthermore, these known lamps do not contain mercury and the discharge arc is comparatively diffuse.

On the contrary, British patent application No. 2,000,637 discloses metal halide discharge lamps containing mercury and a rare gas which consume a power of less than 250 W. According to this Application, the discharge space must be ovoidal or spherical and this space is preferably wider in proportion to its length as the power of the lamp is lower. With a power of 30 W, the discharge space of the lamp described is even spherical. Moreover, the wall of the lamp envelope is thin. It has been found, however, that this known lamp of low power has a discharge arc which is inadmissibly curved for use in headlights.

The lamp according to the invention may be provided with a lamp cap so that it can be arranged as a replaceable lamp in a headlight provided with a reflector and a front pane. In order to avoid reflections, the lamp preferably has no outer bulb. Another possibility is to assemble the lamp with a reflector and a front pane so as to form a unit. Due to its at least substantially rectilinear and contracted arc, the lamp is particularly suitable for producing a dipped beam by means of a screen which extends laterally of the track between the electrodes and consequently screens a part of the reflector. Such a screen may consist, for example, of ceramic material.

Due to the fact that the lamp according to the invention has a very high brightness, which is several times higher that that of a halogen incandescent lamp, a reflector with a comparatively small reflective surface is sufficient to obtain the usual standardized beams. Consequently, it is possible to use a reflector which is flattened to such an extent that the front pane is only a few, for example, 5 cms high. This has the advantage that the front of a vehicle in which the lamp according to the invention is used can be lower so that the vehicle has a lower resistance to air.

Generally, the discharge space of the lamp according to the invention is substantially circular-cylindrical, although it may taper towards the ends of the lamp envelope. In embodiments with a remainder of an exhaust tube, the latter is situated, if possible, near an electrode. Also if the exhaust tube remainder is situated between the electrodes, this remainder, together with the increase in volume of the lamp envelope due to this exhaust tube remainder, is made as small as possible in order to prevent a cold point from being formed. In order to determine the quantity of mercury in the lamp, the inner diameter D of the lamp envelope is measured in a plane passing through the center line of the lamp envelope outside which the exhaust tube remainder is situated. The lamp envelope has a comparatively thick wall, as a result of which a more homogeneous temperature is obtained along the circumference of the lamp. The wall thickness of the lamp envelope may be the same throughout the length of the discharge space, but may alternatively be smaller near the ends of the discharge space. As in the known lamp, the vacuum-tight seals of the lamp envelope generally have small transverse dimensions in order to limit thermal losses. The current-supply conductors may consist of metal foils at the area of the seals, but in an embodiment which is favorable due to the small transverse dimensions of the seal they consist of metal wire.

Embodiments of the lamp according to the invention are shown in the drawings. In the drawings.

Figure 1:
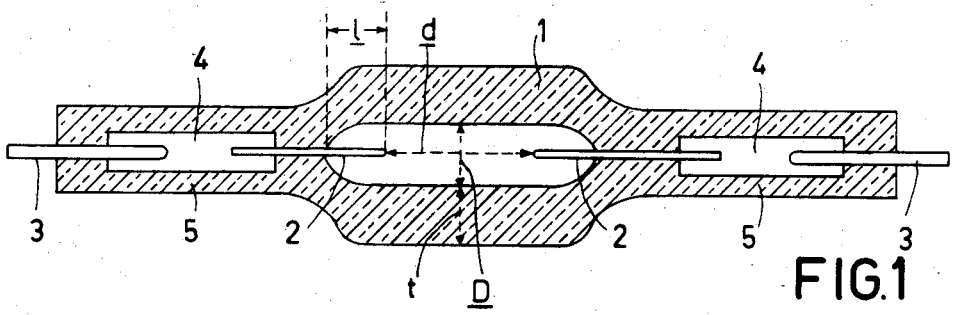
FIG. 1 is a longitudinal sectional view of a lamp.

The lamp shown in FIG. 1 has a tubular lamp envelope 1 of quartz glass, in which a respective electrode 2 is arranged near each of its ends. In the Figure, the electrode is a thoriated tungsten pin, but the electrode may alternatively be a tungsten wire helically wound onto a pin. Current-supply conductors 4,3 extend from the electrodes through vacuum-tight seals 5 of the lamp envelope to the exterior. In the Figure, the current-supply conductors each consist of a metal foil 4 of tungsten or molybdenum and a wire 3, generally of molybdenum. In the Figure, the vacuum-tight seal 5 is a pinch. However, according to another possibility, a seal is obtained by fusing the quartz glass with a wire coated with quartz glass. The wire then combines the functions of the electrode 2, the foil 4 and the wire 3.

The inner diameter of the lamp envelope 1 halfway between the electrodes 2 is designated by D; the distance between the tips of the electrodes 2 is denoted by d; the distance over which the electrodes each project into the lamp envelope is denoted by 1, and the thickness of the wall of the lamp envelope 1 halfway between the electrodes is designated by t.

The lamp envelope is filled with a mixture of rare gas, mercury, and metal halide.

EXAMPLE

An example of a lamp according to the invention having the shape shown in FIG. 1, is characterized by the following values:

| | |
|---|---|
| —D = 2.5 mm | ($1 \leqq D \leqq 3$ mm) |
| d = 4.5 mm | ($3.5 \leqq d \leqq 6$ mm) |
| 1 = 1.0 mm | ($0.5 \leqq 1 \leqq 1.5$ mm) |
| t = 1.75 mm | ($1.5 \leqq t \leqq 2.5$ mm) |
| A = 1.8 mg | ($0.002\,(d + 4 \cdot 1)\,D^2 \leqq A \leqq 0.2\,(d + 4 \cdot 1)\,D^{\frac{1}{2}}$) |

(d+4·l)D exp (166 ) argon: filling pressure 53,500 Pa. A dosing of 1 mg of a mixture of sodium iodide, scandium iodide and thorium iodide the molar ratio of the iodides being 94.5:4.4:1.1. The lamp was operated in a horizontal position at a voltage of 100 V, 7 kHz and consumed a power of 35 W. The luminous flux of the lamp was 2500 lm. The discharge arc halfway between the electrodes had a diameter of 1 mm and at this point its center line was displaced 0.4 mm with respect to the imaginary straight connection line between the points at which the arc terminates on the electrodes, which had a diameter of 350 μm.

Figure 2:
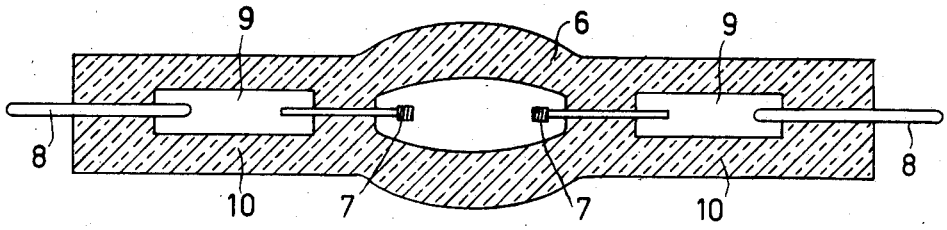
FIG. 2 shows another embodiment of a lamp in longitudinal sectional view.

In FIG. 2, corresponding parts are designated by a reference numeral which is 5 higher than in FIG. 1. The (discharge) space inside the lamp envelope 6 is now elongate and barrel-shaped.

Figure 3:
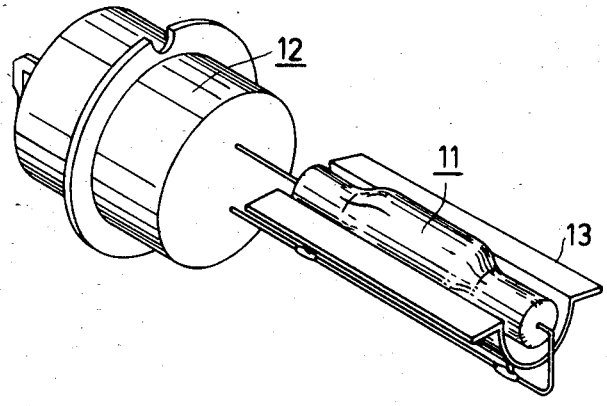
FIG. 3 is a side elevation of a capped lamp.

In FIG. 3, the lamp 11 has a lamp cap 12 and a screen 13 which extends laterally of the track between the electrodes and which, when the lamp is arranged in a reflector, screens a part of the reflector so that a dipped beam is produced.

Figure 4:
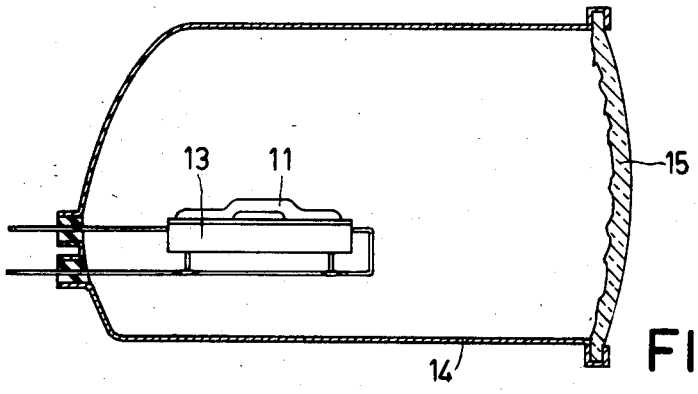
FIG. 4 shows a lamp-reflector unit in longitudinal sectional view, the lamp being shown in side elevation.

In FIG. 4, the lamp is arranged together with a screen 13 in a reflector 14 which is provided with a front pane 15. The reflector is parabolically curved, but is flattened on its upper and lower sides. The flattened portions are so arranged that the optical axis of the reflector on which the lamp is mounted lies beneath half the height of the reflector. The part of the reflector lying beneath the optical axis is screened for the major part by the screen 13. Due to the geometrically asymmetrical arrangement of the lamp, with a given reflector height a comparatively large reflective surface is effectively operative for producing a dipped beam.

The lamp according to the aforementioned example, when arranged in a reflector of the kind shown in FIG. 4 having an overall height of 5 cm, produced an excellent dipped beam.

What is claimed is:

1. A gas discharge lamp, suitable for use in a reflector as a vehicle headlight lamp, comprising a lamp envelope of quartz glass having an elongate discharge space in which a respective electrode is arranged near each of its ends, current-supply conductors being passed from these electrodes through vacuum-tight seals in the discharge envelope to the exterior, the lamp envelope being filled with an ionizable gas filling, characterized in that the gas filling comprises a rare gas, mercury, and a metal halide, in that the wall thickness t of the lamp envelope is halfway between the electrodes 1.5–2.5 mm, in that the inner diameter D of the lamp envelope halfway between the electrodes is 1–3 mm, the distance d between the tips of the electrodes is 3.5–6 mm, the distance l over which the electrodes each project into the lamp envelope is 0.5–1.5 mm and in that the quantity A, in mg, of mercury in the lamp envelope corresponds to the formula:

$$0.002(d+4\cdot l)D^2 \leqq A \leqq 0.2(d+4\cdot l)D^{\frac{1}{2}}$$

in which D, d and l are expressed in mm.

2. A gas discharge lamp as claimed in claim 1, provided with a lamp cap and a screen extending laterally of the track between the electrodes.

3. A gas discharge lamp as claimed in claim 1 provided with a reflector, a front pane, and a screen screening a part of the reflector.

4. A gas discharge lamp as claimed in claim 1 wherein the wall thickness of the lamp envelope is smaller near the ends of the discharge space.

5. A miniature metal halide discharge lamp, comprising:

a substantially transparent lamp envelope having an elongate internal cavity for containing a lamp filling and a discharge formed within said lamp filling and for allowing light from the discharge to pass through the lamp envelope without appreciable scattering;

a pair of discharge electrodes within said elongate cavity spaced at opposite ends of the cavity and energizable for forming an electric discharge therebetween;

said electrodes extending into said cavity a distance l such that 0.5 mm$\leqq$l$\leqq$1.5 mm, and said electrodes spaced a distance d such that 3.5 mm$\leqq$d$\leqq$6 mm;

said lamp envelope having a maximum wall thickness t located midway between the electrodes such that 1.5 mm$\leqq$t$\leqq$2.5 mm, and an inner diameter D at the middle portion thereof such that 1 mm$\leqq$D$\leqq$3 mm;

a lamp filing comprising a rare gas, a metal halide and a quantity A mg of mercury such that $$0.002(4l+d)D^2 \leqq A \leqq 0.2(4l+d)D^{\frac{1}{2}};$$

and the electrode extent l, electrode spacing d, maximum wall thickness t midway between the electrodes, cavity diameter D midway between the electrodes and mercury qantity A are selected such that when the lamp is horizontally operated arc bowing from the electrode centerline is minimized.

6. A miniature metal halide discharge lamp according to claim 5, wherein said internal cavity is approximately circular cylindrical.

7. A miniature metal halide discharge lamp according to claim 6, wherein said cavity wall thickness is approximately uniform.

8. A miniature metal halide discharge lamp according to claim 5, wherein said internal cavity has a mxaimum diameter located midway between said electrodes and tapers smoothly to a smaller diameter in the direction of either electrode.

9. A miniature metal halide discharge lamp according to claim 5, wherein the electrode extent l, electrode spacing d, maximum wall thickness t, maximum cavity diameter D and mercury quantity A are effective to develop during lamp operation an arc having a center line having a maxium dispalcement from the electrode centerline of about 0.4 mm.

10. A miniature metal halide discharge lamp, comprising:

a substantially transparent lamp envelope having an elongate internal cavity and a maximum wall thickness t located at the middle portion thereof and the wall thickness decreasing at locations away from the middle of the cavity;

said lamp envelope having a maximum wall thickness t such that 1.5 mm$\leqq$t$\leqq$2.5 mm, and an inner diameter D at the middle portion thereof such that 1 mm$\leqq$D$\leqq$3 mm; p1 a pair of discharge electrodes, each disposed extending into said cavity a distance l such that 0.5 mm$\leqq$l$\leqq$1.5 mm and at opposite ends of said cavity spaced a distance d such that 3.5 mm$\leqq$d$\leqq$6 mm;

A lamp filling for developing an electric arc discharge and emitting light when said discharge electrodes are sufficiently energized, comprising a rare gas, a metal halide and a quantity A mg of mercury such that $$0.002\ (4l+d)D^2 \leqq A \leqq 0.2(4l+d)D^{\frac{1}{2}};$$

and the electrode extent l, electrode spacing d, maximum wall thickness t, cavity diameter D and mercury quantity A are selected such that when the lamp is horizontally operated the arc is maximally constricted and at least approximately rectilinear.

11. A miniature metal halide discharge lamp according to claim 10, wherein said internal cavity has a maximum diameter located midway between said electrodes and tapers smoothly to a smaller diameter in the direction of either electrode.

12. A miniature metal halide discharge lamp according to claim 16, wherein said internal cavity is approximately circular cylindrical.

13. A miniature metal halide discharge lamp according to claim 10, wherein the electrode extent l, electrode spacing d, maximum wall thickness t, cavity diameter D and mercury quantity A are effective to develop during lamp operation an arc having a maximum diameter of about 1 mm and having a center line having a maximum displacement from the electrode center line of about 0.4 mm.

* * * * *

UNITED STATES PATENT AND TRADEMARK OFFICE

CERTIFICATE OF CORRECTION

PATENT NO. : 4,594,529

DATED : June 10, 1986

INVENTOR(S) : Bertus de Vrijer

It is certified that error appears in the above-identified patent and that said Letters Patent is hereby corrected as shown below:

Claim 10, line 11 (column 6, line 26) delete "pl"; start a new paragraph with "a pair"

Claim 10, line 16 (column 6, line 31) change "A" to --a--

Signed and Sealed this

First Day of December, 1987

*Attest:*

DONALD J. QUIGG

*Attesting Officer*

*Commissioner of Patents and Trademarks*